United States Patent [19]

Arvesen

[11] Patent Number: 5,073,333

[45] Date of Patent: Dec. 17, 1991

[54] DECONTAMINATION METHOD

[75] Inventor: Jan Arvesen, Nykoping, Sweden

[73] Assignee: Studsvik AB, Nykoping, Sweden

[21] Appl. No.: 424,238

[22] PCT Filed: Jul. 7, 1989

[86] PCT No.: PCT/SE89/00399

§ 371 Date: Oct. 24, 1989

§ 102(e) Date: Oct. 24, 1989

[87] PCT Pub. No.: WO90/01774

PCT Pub. Date: Feb. 22, 1990

[30] Foreign Application Priority Data

Aug. 11, 1988 [SE] Sweden ..... 8802872-5

[51] Int. Cl.[5] ..... G21C 19/42

[52] U.S. Cl. ..... 376/310; 376/305; 376/309

[58] Field of Search ..... 376/310, 305, 309; 252/626, 188.26; 134/3, 41; 423/235, 219, 250

[56] References Cited

U.S. PATENT DOCUMENTS

| | | | |
|---|---|---|---|
| 4,548,790 | 10/1985 | Horwitz et al. | 423/9 |
| 4,657,596 | 4/1987 | Murray et al. | 134/3 |
| 4,704,235 | 11/1987 | Arvesen | 252/626 |
| 4,880,559 | 11/1989 | Murray et al. | 376/310 |

*Primary Examiner*—Donald P. Walsh
*Assistant Examiner*—Neena Chelliah
*Attorney, Agent, or Firm*—Burns, Doane, Swecker & Mathis

[57] ABSTRACT

A method of decontaminating radio nuclide-contaminated corrosion products, which are sparingly soluble in acid, from primary system surfaces in reactors of the pressurized water reactor type and the boiler reactor type with hydrogen dosage and similar, by oxidation and concurrent dissolution in an acidic decontamination solution of the acid soluble corrosion products obtained by said oxidation. The characteristic feature of the method is that said oxidation is performed with $Ce^{4+}$ ions, ozone and chromic acid in the presence of perhalogen acid, preferably perchloric acid, at a pH below 3.

33 Claims, No Drawings

DECONTAMINATION METHOD

TECHNICAL FIELD

The present invention relates to a method by which radioactive coatings or deposits on the walls of the primary heating system in nuclear reactors of the pressurized water type, the boiler reactor type with hydrogen dosage, etc., can be removed. More specifically, the invention relates to the decontamination of acid insoluble or in acid sparingly soluble corrosion or oxidation products from such primary system surfaces. In this respect the invention is a development of the technique which comprises contacting the contaminated surfaces with an oxidation agent in an acid solution and dissolving those corrosion products which have been made acid soluble by said oxidation.

BACKGROUND OF THE INVENTION

The background of and an elucidation of the problems in connection with corrosion products derived from the primary heating system of nuclear reactors are closely described in U.S. Pat. No. 4,704,235 (corresponds to Swedish Publication No. 451,915 and U.S. Pat. No. 4,704,235. Said patent specification also discloses a method by means of which many of the problems within this area are eliminated or at least substantially reduced. Said method is especially adapted for use in operating and maintaining working plants of the pressurized water reactor type. The present invention represents a development of the method referred to, where the invention has been shown to give an improved decontamination effect as well as the possibility of obtaining a final product that is less environmentally harmful or more suited to be deposited than the final product disclosed in the above-mentioned Swedish patent specification. In this context, it has turned out that the invention is such effective and advantageous that it is especially well suited for the decontamination of reactors in connection with an ultimate demolition thereof or a scrapping of spent components thereof.

A practically useful and accepted method of last-mentioned type is definitely desired in Sweden today. Thus, the Swedish nuclear plants comprise reactors which were started between 1972 and 1985. A natural consequence thereof is that the requirements for maintenance and repairs of system components will continue to increase. Eventually some of these components have to be replaced. Replacements have already started of a number of large components, such as preheaters, moisture separators, etc., at some of those plants which were started first.

The replaced components can either be transferred to SFR for an ultimate deposit, optionally after some intermediate deposit in the plants, or be conditioned for example to make possible a free-classification/recycling of material. If the latter alternative is chosen, which is the preferred one if one wants to minimize the total volume of waste to be sent to the ultimate deposit, there will for instance be a great demand for decontamination methods giving high decontamination factors (DF). In addition thereto it must be possible to take care of the secondary waste obtained in an acceptable way. It has been found that the method according to the invention gives a solution to said problem.

In this context it can be added that today a number of "hard" decontamination methods are available but that generally these methods are characterized by several treatment steps, which for instance means that large amounts of chemicals have to be taken care of. Furthermore, many of these chemicals are difficult to treat.

The method according to U.S. Pat. No. 4,704,235 is based on an exposure of the contaminated surfaces or oxides to an oxidation agent in an acid solution, which oxidation agent is a combination of $Ce^{4+}$ ions, ozone and chromic acid, nitric acid being specifically mentioned as the most effective and suitable acid. The present invention is based on principally the same oxidation components, i.e. $Ce^{4+}$, ozone and chromic acid, the oxidation, however, being performed under different acid conditions than according to the prior art, which has been found to give essential advantages for many purposes.

U.S. Pat. No. 4,657,596 discloses the use of a decontamination agent which may contain a perhalogen acid, but said decontamination agent does not comprise all components which are required according to the present invention to obtain a synergistic effect. Furthermore, U.S. Pat. No. 4,657,596 does not disclose or even suggest that a perhalogen acid might be better than any of the other acids mentioned. Rather, the best decontaminating factors are obtained by means of an agent based on sulphuric acid.

GENERAL DISCLOSURE OF THE INVENTION

More specifically, the present invention relates to a method of decontaminating radio nuclide-contaminated corrosion products, which are sparingly soluble or insoluble in acids, from primary system surfaces in nuclear reactors of the pressurized water type and the boiler type with hydrogen dosage or similar, where the contaminated surfaces are contacted with an oxidation agent in an acid solution so as to obtain an oxidation in the presence of $Ce^{4+}$ ions, ozone and chromic acid, and the corrosion products which have been made acid soluble through said oxidation are dissolved. The novel feature of the invention is that it has surprisingly been found that essential improvements relative to the prior art can be obtained if said oxidation with $Ce^{4+}$ ions, ozone and chromic acid is performed in the presence of perhalogen acid at relatively low pH values.

More specifically, the method according to the invention is characterized by performing the oxidation with $Ce^{4+}$ ions, ozone and chromic acid with such concentrations thereof which are required for the decontamination, in the presence of perhalogen acid at a pH below 3.

Thus, it has been found that essentially higher decontamination factors are obtained by means of perhalogen acid as the acid to be used in the oxidation, the use of perhalogen acid also representing the essential advantage that after the finalized treatment said acid can be reduced in a manner known per se to any halogenide-containing compound, which is considerably more suitable for deposition than an environmentally non-favourable nitrate or any environmentally non-favourable nitrogen compound according to the prior art. In this context, it has been found that the method according to the invention is such effective that it is especially well suited for the decontamination of reactors for a complete demolition or dismantling thereof or for a scrapping of components from said reactors.

The measure that the oxidation reaction according to the present invention is performed "in the presence of perhalogen acid" should be interpreted in a wide sense, i.e. it is not absolutely necessary to add perhalogen acid initially as the acid medium, although this is generally the most suitable and preferred embodiment. Thus, said perhalogen acid can also be formed in situ in the reaction by starting from a halogen-containing acid, where the halogen is present in a lower valence state or stage than in perhalogen acid, the starting acid being oxidized by the present ozone up to perhalogen acid during the reaction.

As perhalogen acid such as perchloric acid is preferably used, but the method could be performed also with perbromic acid or periodic acid, although the two last-mentioned acids are somewhat weaker as oxidizing agents than the preferred perchloric acid. Therefore, for convenience the invention will be discribed in connection with a use of perchloric acid, although it should be understood that corresponding considerations are applicable to perbromic and pariodic acid, respectively.

As was mentioned above the oxidation is performed at relatively low pH values, viz. at a pH below 3, an especially preferable embodiment, however, being a performance of the method at a pH of at most 2 or below 2 or even more preferable at most 1 or below 1, especially within the pH range of 1-0.5.

Generally this means that the oxidation is performed with perhalogen acid, preferably perchloric acid, having a molarity within the range of 0.01-8M, preferably within the range of 0.1-2M.

As will be illustrated more below the claimed combination of oxidation agents in the specified perhalogen acid medium has been shown to give an unexpectedly good synergistic effect. This means that the amounts or concentrations used of the different components of the oxidation system are not primarily the characteristic features of the invention, but said concentrations can of course easily be determined by the skilled artisan in each case based on the decontamination effect desired or required. Generally, however, it can be mentioned that suitable concentrations are the following: $Ce^{4+}$, i.e. calculated as cerium in the utilized salt, within the range of 0.01-50 g per liter of used aqueous solution; ozone within the range of 0.001-1 g/l and chromic acid in a contration of 0.001-50 g/l.

Especially preferable concentrations according to the invention within the above-defined ranges are 0.5-10 g/l as concerns cerium, 0.001-0.05 g/l as concerns ozone and 0.005-0.2 g/l as concerns chromic acid.

Otherwise, the components of the combined oxidation agent according to the invention can principally be chosen in accordance with the prior art, i.e. mainly in accordance with the disclosure of the above-mentioned Swedish patent specification. Thus, for instance for the cerium component it is not necessary to start from a $Ce^{4+}$ salt, but one may well start from a $Ce^{3+}$ salt, the $Ce^{3+}$ ion automatically being oxidized up to a valence stage of 4 by the present ozone. As said cerium compound or cerium salt it is preferable to start directly with cerium perchlorate as perchloric acid is utilized as the acid medium, i.e. so as to avoid the incorporation of different ions into the system. In such a case cerium perchlorate is prepared in a manner known per se, which need not be described here. Similar considerations are applicable to perbromate and periodate. However, the method according to the invention is applicable to the use of any cerium salt that does not interfere with the reaction, another suitable example of a cerium salt being cerium nitrate. The only matter of importance is that the $Ce^{4+}$ ion required for the oxidation is available. Thus, such cerium salts which give precipitations (for instance cerium sulphate) or gas evolution (for instance cerium chloride) and similar should be avoided.

Also the chromic acid can be selected in accordance with those principles which are disclosed in the above-mentioned Swedish patent specification. However, it can be added that the primary feature of the invention is that chromic acid is present during the oxidation reaction per se. This does not necessarily mean that an external additional chromic acid is necessary, since the method is essentially merely intended for the decontamination of chromium-containing steel, which means that the requisite quantities or concentrations of chromic acid are automatically formed after some starting period of operation. It has also been shown that the present method gives a remarkably good effect as concerns the dissolution of chromium rich spinels of the type that it present in pressurized water reactors, etc. However, an external as well as initial addition of chromic acid is preferred according to the invention.

Also concerning the ozone the previously known principles for the addition thereof are applicable, i.e. essentially those principles which are disclosed in the above-mentioned Swedish patent specification. According to a preferable embodiment of the invention this means that as the oxidation agent there is used an acid aqueous solution of the cerium compound and the chromic acid and ozone in a preferably saturated solution and in the dispersed form. However, according to another embodiment of the method according to the invention the oxidation agent can be utilized in the form of a two-phase ozone gas-aqueous mixture, where ozone in gaseous form has been dispersed in an acidic aqueous solution of cerium compound and chromic acid.

It has been found that the method according to the invention is such effective that it is possible to perform in one single step the oxidation as well as the dissolution with the desired results, which means that this is also a preferable embodiment of the method.

Another advantage of the method is that the desired results can be obtained when performing said method at such a low temperature as room temperature, which is of course very valuable. Thus, an especially preferable embodiment of the method according to the invention means that the decontamination is performed at room temperature or even lower, i.e. primarily at a temperature within the range of 20°-30° C., especially within the range of 20°-25° C. However, the method according to the invention is of course performable also at higher temperatures, although it may generally be suitable to work at a temperature below about 60° C., since otherwise the decomposition of for instance ozone may become so vigorous that it counteracts the effect that is generally achieved by raising the temperature, i.e. the common effect that the reaction rate increases with increasing temperatures.

As was mentioned above the method according to the invention is advantageous through the choice of perchloric acid also through the fact that after the finalized treatment said acid can be reduced in a manner known per se to a more environmentally favourable waste or deposit product than the previously specifically mentioned nitrate. Thus, a preferable embodiment of the method according to the invention means that the solution obtained after oxidation and dissolution is treated with a previously known reducing agent to reduce the perchloric acid to an environmentally favourable chloride salt. Such a chloride salt may for instance be sodium chloride, said reducing agent for instance being sodium sulphide. In this case there is obtained as the end product, in addition to sodium chloride, also sodium sulphate and an extremely minor amount of colloidal sulphur. Since the seawater contains sodium chloride as well as sodium sulphate a discharge of the end product referred to into said recipient would be possible without causing any problems. As has already been stated above corresponding considerations are applicable to perbromic and periodic acids, bromide and iodide, respectively, being obtained.

However, before said reduction of perchloric acid is performed any conventional purification of the solution may be accomplished. This can be made by adding after the finalized decontamination ascorbic acid in the desired concentration, for instance 1-2 g/l, the following reduction reactions taking place:

$Cr^{6+}$ present in the solution as chromate is reduced to $Cr^{3+}$ $Ce^{4+}$ is reduced to $Ce^{3+}$ $Fe^{3+}$ is reduced to $Fe^{2+}$ $O_3$ is reduced to $O_2$.

On the contrary the perchloric acid is not effected by the ascorbic acid.

As an alternative to sodium sulphide as the reducing agent of this kind reference can be made to a hydroxylamine compound, for instance the nitrate, acetate or chloride.

After the addition of ascorbic acid one can then perform a conventional purification with cation exchange resin, all metals and nuclides present being completely removed. The purified solution now contains perchloric acid plus a minor amount of nitric acid (for example in a concentration of about 25 g/l and 3.5 g/l, respectively). Then the reduction referred to above is performed with an inorganic reducing agent, for instance sodium sulphide.

An alternative as concerns the waste handling means that the solution purified with a cation exchange resin is then purified with an anion exchange resin. After a treatment with lime the anion exchange resin mass is then cast throughout or within cement.

The invention will now be further illustrated by the following working examples.

EXAMPLE

Four experiments were performed on test materials taken from Ringhals 2 PWR (=pressure water reactor), where in all experiments two samples from "manway insert" and two tube samples from steam generators were utilized. The characteristics of each of said four experiments are presented below:

EXPERIMENT 1:

Chemistry: (dissolved in $H_2O$ to 1000 ml)
22 ml of $HClO_4$:0.25M
$O_3$:5-15 ppm (in solution )
t=22° C.
Stirring
Exposure time: 18 h

EXPERIMENT 2:

Chemistry: (dissolved in $H_2O$ to 1000 ml)
22 ml of $HClO_4$:0.25M
8 g of cerium nitrate with all cerium as $Ce^{4+}$
$O_3$: no addition
t=22° C.
Stirring
Exposure time: 18 h

EXPERIMENT 3:

Chemistry: (dissolved in $H_2O$ to 1000 ml)
22 ml of $HClO_4$:0.25M
50 mg of $Cr^{6+}$ as $CrO_3$
$O_3$: no addition
t=22° C.
Stirring
Exposure time: 18 h

EXPERIMENT 4:

Chemistry: (dissolved in $H_2O$ to 1000 ml)
8 g of $Ce(No_3)_3 \times 6\ H_2O$
22 ml of $HClO_4$:0.25M
50 mg of $Cr^{6+}$ as $CrO_3$
$O_3$:5-15 ppm (in solution)
t=22° C.
pH=0.76
Stirring
Exposure time: 18 h Gamma-spectrometric measurements (only Co60) of the samples before and after the decontaminations gave the following decontamination factors:

| | Measured Decon factors |
|---|---|
| Experiment 1: | |
| Insert sample 1 | 1.03 |
| Insert sample 2 | ≈1 |
| Steam generator tube sample 1 | 1.08 |
| Steam generator tube sample 2 | 1.1 |
| Experiment 2: | |
| Insert sample 1 | 178 |
| Insert sample 2 | 165 |
| Steam generator tube sample 1 | 3.6 |
| Steam generator tube sample 2 | 5.35 |
| Experiment 3: | |
| Insert sample 1 | ≈1 |
| Insert sample 2 | 1.03 |
| Steam generator tube sample 1 | 1.05 |
| Steam generator tube sample 2 | 1.05 |
| Experiment 4: | |
| Insert sample 1 | 5850 |
| Insert sample 2 | 6400 |
| Steam generator tube sample 1 | 66700 |
| Steam generator tube sample 2 | 17700 |

Based on the Decon factors obtained it is clear and unambiguous that the combination of all oxidation agents in accordance with the present invention (experiment 4) gives a synergistic effect which was not predictable in view of the known properties of the oxidation agents per se.

Furthermore, a comparative experiment was performed in the manner described above and in accordance with those characteristics which are presented below for experiment 5. Said experiment 5 corresponds to the method according to the above-mentioned Swedish patent specification 8401336-6.

EXPERIMENT 5:

Chemistry: (dissolved in $H_2O$ to 1000 ml)
8 g of $Ce(NO_3)_3 \times 6\ H_2O$
17.5 ml of $HNO_3$: 0.25M
$O_3$: 5-15 ppm (in solution)
t=22° C.

Stirring

| | Mesasured Decon factors |
|---|---|
| Insert sample 1 | 3870 |
| Insert sample 2 | 2980 |
| Steam generator tube sample 1 | 1830 |
| Steam generator tube sample 2 | 1880 |

A comparison between the result of the above-mentioned experiment 4 and that of experiment 5 shows that the decontamination according to the present invention is quite superior to the decontamination obtained by the previously known technique.

I claim:

1. A method of decontaminating radio nuclide-contaminated corrosion products, which are insoluble or sparingly soluble in acids, from primary systems surfaces in nuclear reactors of the pressurized water type, the boiler reactor type with hydrogen dosage and similar, especially for the decontamination for the purpose of demolishing or scrapping such reactors or components thereof, where the contaminated surfaces are contacted with an oxidation agent in an acid solution so as to obtain an oxidation in the presence of $Ce^{4+}$ ions, ozone and chromic acid, and the corrosion products which have been made acid soluble by means of said oxidation are dissolved, characterized by performing said oxidation with $Ce^{4+}$ ions, ozone and chromic acid with concentrations thereof required for said decontamination, in the presence of perhalogen acid at a pH below 3.

2. A method according to claim 1, characterized by performing said oxidation in the presence of $Ce^{4+}$ in a concentration of 0.01-50 g/l, ozone in a concentration of 0.001-1 g/l and chromic acid in a concentration of 0.001-50 g/l.

3. A method according to claim 1, characterized by using as said cerium compound cerium perhalogenate perchlorate, or cerium nitrate.

4. A method according to claim 1, characterized by performing said oxidation in the presence of perhalogen acid in such a concentration that the pH value is below 2.

5. A method according to claim 1, characterized by performing said oxidation with perhalogen acid having a molarity within the range of 0.01-8M.

6. A method according to claim 1, characterized by using as said oxidizing agent an acidic aqueous solution of $Ce^{4+}$ and chromic acid as well as ozone in a saturated solution and dispersed form.

7. A method according to claim 1, characterized by using as said oxidation agent a two-phase ozone gas-aqueous mixture where ozone in gaseous form has been dispersed in an acidic aqueous solution of $Ce^{4+}$ and chromic acid.

8. A method according to claim 1, characterized by performing the oxidation and dissolution in one and the same step.

9. A method according to claim 1, characterized by performing the oxidation and dissolution at a temperature below about 60° C.

10. A method according to claim 1, characterized by performing the oxidation with an external addition of chromic acid to the oxidation solution.

11. A method according to claim 1, characterized by performing said oxidation in the presence of $Ce^{4+}$ in a concentration of 0.5-10 g/l, ozone in a concentration of 0.001-0.05 g/l and chromic acid in a concentration of 0.005-0.2 g/l.

12. A method according to claim 2, characterized by using as said cerium compound cerium perhalogenate, or cerium nitrate.

13. A method according to claim 2, characterized by performing said oxidation in the presence of perhalogen acid in such a concentration that the pH value is below 2.

14. A method according to claim 2, characterized by performing said oxidation with perhalogen acid having a molarity within the range of 0.01-8M.

15. A method according to claim 2, characterized by using as said oxidation agent an acidic aqueous solution of $Ce^{4+}$ and chromic acid as well as ozone in a saturated solution and dispersed form.

16. A method according to claim 2, characterized by using as said oxidation agent a two-phase ozone gas-aqueous mixture where ozone in gaseous form has been dispersed in an acidic aqueous solution of $Ce^{4+}$ and chromic acid.

17. A method according to claim 2, characterized by performing the oxidation and dissolution in one and the same step.

18. A method according to claim 2, characterized by performing the oxidation and dissolution at a temperature below about 60° C.

19. A method according to claim 2, characterized by performing the oxidation with an external addition of chromic acid to the oxidation solution.

20. A method according to claim 2, characterized by performing said oxidation in the presence of $Ce^{4+}$ in a concentration of 0.5-10 g/l, ozone in a concentration of 0.001-0.05 g/l and chromic acid in a concentration of 0.005-0.2 g/l.

21. A method according to claim 1 wherein said perhalogen acid is perchloric acid.

22. A method according to claim 3 wherein said cerium perhalogenate is cerium perchlorate.

23. A method according to claim 1 wherein said perhalogen acid is provided in such a concentration that the pH value is below 1.

24. A method according to claim 1 wherein said perhalogen acid is provided in such a concentration that the pH value is within the range of 0.5-1.

25. A method according to claim 1, characterized by performing said oxidation with perhalogen acid having a molarity within the range of 0.1-2M.

26. A method according to claim 9, characterized by performing the oxidation and dissolution at a temperature within the range of 20°-30° C.

27. A method according to claim 9, characterized by performing the oxidation and dissolution at a temperature within the range of 20°-25° C.

28. A method according to claim 2, characterized by using as said cerium compound cerium perchlorate.

29. A method according to claim 2, wherein perhalogen acid is provided in such a concentration that the pH value is below 1.

30. A method according to claim 2, wherein said perhalogen acid is provided in such a concentration that the pH value is within the range of 0.5-1.

31. A method according to claim 2, characterized by performing said oxidation with perhalogen acid having a molarity within the range of 0.1-2M.

32. A method according to claim 2, characterized by performing the oxidation and dissolution at a temperature within the range of 20°-30° C.

33. A method according to claim 2, characterized by performing the oxidation and dissolution at a temperature within the range of 20°-25° C.

* * * * *